United States Patent [19]

Wedel

[11] Patent Number: 4,698,919

[45] Date of Patent: Oct. 13, 1987

[54] APPARATUS FOR ASSISTING THE TRANSFER OF A WEB TO A DRYING SECTION

[75] Inventor: Gregory L. Wedel, Beloit, Wis.

[73] Assignee: Beloit Corp., Beloit, Wis.

[21] Appl. No.: 887,542

[22] Filed: Jul. 18, 1986

Related U.S. Application Data

[63] Continuation-in-part of Ser. No. 857,747, Apr. 8, 1986, Pat. No. 4,669,198.

[51] Int. Cl.[4] ..... F26B 13/08

[52] U.S. Cl. ..... 34/117; 34/120; 162/202

[58] Field of Search ..... 34/114, 116, 117, 120, 34/123, 122; 162/202, 207, 305, 306, 290

[56] References Cited

U.S. PATENT DOCUMENTS

| | | | |
|---|---|---|---|
| 4,016,032 | 4/1977 | Kankaanpaa | 162/305 |
| 4,359,828 | 11/1982 | Thomas | 34/116 |
| 4,551,203 | 11/1985 | Eskelinen | 34/116 |

*Primary Examiner*—Larry I. Schwartz

*Attorney, Agent, or Firm*—Dirk J. Veneman; Raymond W. Campbell; David J. Archer

[57] ABSTRACT

An apparatus is disclosed for assisting the transfer of a web disposed contiguous relative to a transfer felt such that the web is transferred from a lead-in roll disposed adjacent to a press section to a first dryer of a papermaking machine dryer section. The apparatus includes an intermediate support roll disposed between the lead-in roll and the first dryer such that the transfer felt is disposed between the web and the intermediate roll. A first transfer box is disposed between the lead-in roll and the intermediate roll such that the transfer felt is disposed between the web and the first transfer box. The first transfer box is oriented relative to the transfer felt such that a partial vacuum is generated between the first box and the transfer felt for drawing the web into close conformity with the transfer felt between the lead-in roll and the intermediate roll. A second transfer box is disposed between the intermediate roll and the first dryer such that the transfer felt is disposed between the web and the second box. The second box is oriented relative to the transfer felt such that a partial vacuum is generated between the transfer felt and the second box for drawing the web into close conformity with the transfer felt between the intermediate roll and the first dryer such that any tendency of the web to droop relative to the transfer felt between the lead-in roll and the first dryer is inhibited.

26 Claims, 10 Drawing Figures

12b

106
Wb
10b
10
54
60
66
52
64
38b
56
40b
104
108
62
58
70
110
68
40b
14b
74
82
72
44b
76
80
42b

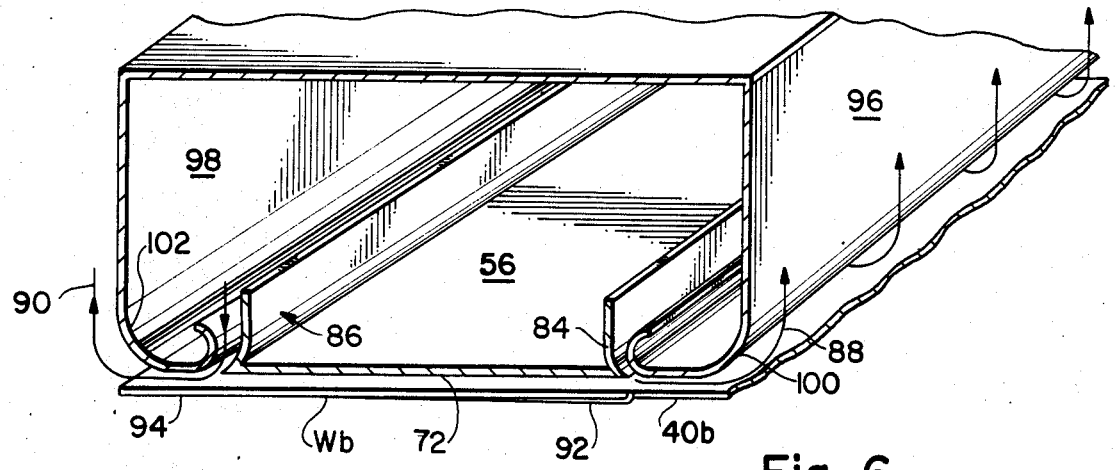
Fig. 6
Fig. 7
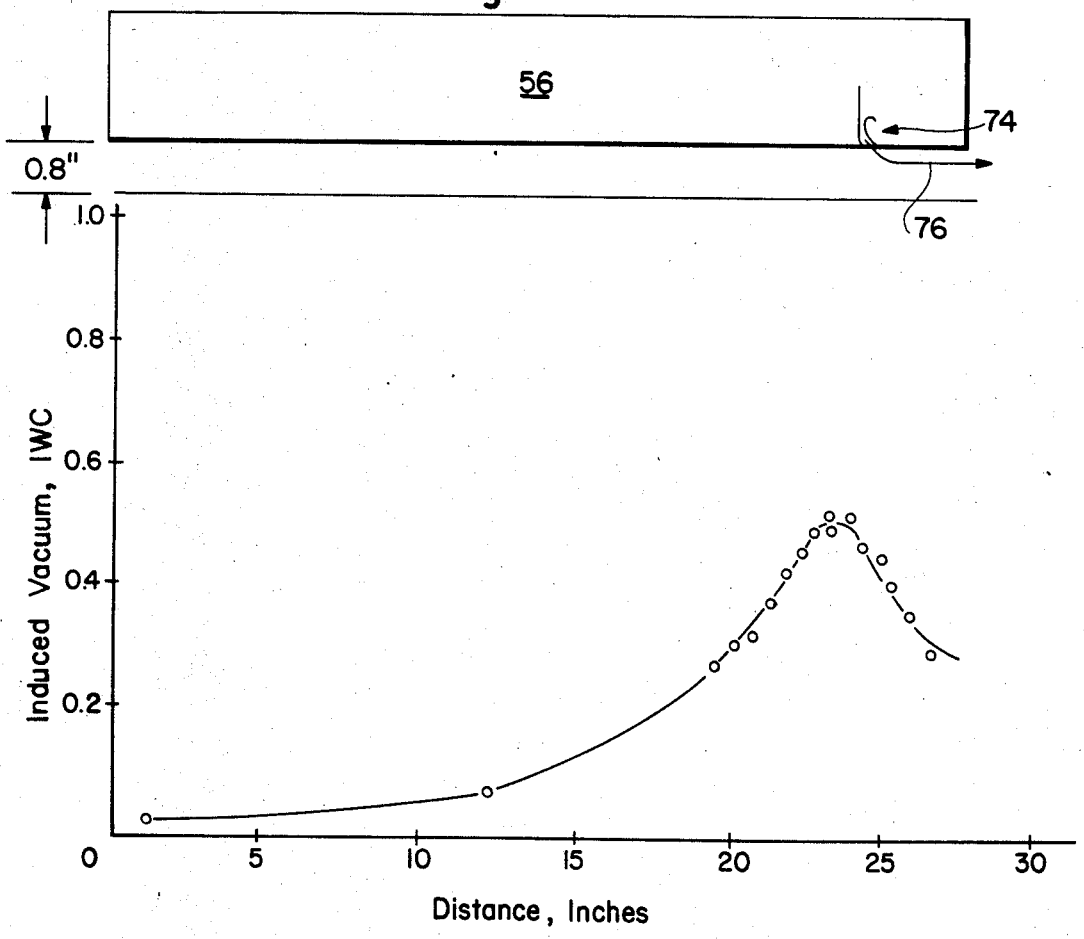

APPARATUS FOR ASSISTING THE TRANSFER OF A WEB TO A DRYING SECTION

CROSS REFERENCE TO RELATED APPLICATIONS

The present application is a continuation in part of U.S. Ser. No. 857,747 filed Apr. 8, 1986 now U.S. Pat. No. 4,669,198. All of the disclosure of U.S. Ser. No. 857,747 is incorporated herein by reference.

BACKGROUND OF THE INVENTION

Field Of The Invention

This invention relates to an apparatus for assisting the transfer of a web disposed contiguous relative to a transfer felt such that the web is transferred from a lead-in roll disposed adjacent to a press section to a first dryer of a papermaking machine dryer section. More particularly, this invention relates to an apparatus for assisting the transfer of a web to a dryer section, the apparatus including a transfer box.

INFORMATION DISCLOSURE STATEMENT

A formed web of paper is passed through a press section of a papermaking machine in order to remove from the formed web excess water within the web. Such pressing of the web not only removes excess water but imparts to the resultant pressed web, a density which is directly related to the inherent strength of the pressed web.

The pressed web is then transferred from the press section to a drying section where the web undergoes treatment as the pressed web passes around a plurality of steam-heated dryers to remove more water from the pressed web.

Such transfer of the fibrous web from the press section to the dryer section requires pulling the pressed web off of the press roll and transferring the same to the first dryer of the dryer section. During such transfer, an unsupported length of web extends between the press section and the dryer section and this open, unsupported length has a tendency to droop away from the transfer felt which normally is used to transfer the web between the press and dryer sections.

In an ideal situation, the pressed web emanating from the press section will closely conform to the transfer felt from a lead-in roll of the transfer felt until the web enters between a nip defined by the transfer felt and a first dryer of the dryer section. However, in actual practice, the web tends to droop, or fall away, from the transfer felt and such resultant slackness in the web makes the web more susceptible to breakage due to various air currents in the vicinity of the transfer felt. Additionally, due to such slackness, there is a tendency of the web to wrinkle as it enters into the afore-mentioned nip.

Various attempts have been made to overcome the afore-mentioned problems. One such attempt is disclosed in West German Pat. No. 3344217 to Voith which teaches a simple box structure disposed above the transfer felt with the box directing a curtain of air away from the transfer felt for drawing the web against the transfer felt.

Another attempt to overcome the aforementioned problem is disclosed in U.S. Pat. No. 4,551,203 to Valmet. This patent teaches a plurality of blow boxes which are disposed above the transfer felt, each of the boxes discharging a jet of air therefrom in a direction parallel to the direction of movement of the transfer felt.

Both the Voith and Valmet patents tend to achieve the objective of firstly—shielding the web from any disturbing air currents in the vicinity of the transfer felt, and secondly—create a slight under-pressure above the transfer felt in order to keep the web from falling off of the transfer felt.

The main problem remaining with the aforementioned prior art devices is that, if sufficient under-pressure (or vacuum) is applied above the transfer felt to hold the web when operating at high speed, the transfer felt is drawn into physical contact with the boxes which causes serious deterioration to the transfer felt.

The present invention is directed towards an apparatus and method that overcomes the aforementioned inadequacy of the prior art devices and which makes a significant contribution to the papermaking art.

In order to fully appreciate how the present invention overcomes the problem of frictional contact between the transfer felt and the transfer box, it is necessary to consider how much deflection will occur with the transfer felt for particular distances between the lead-in roll and the first dryer. The problem has been found to be particularly acute when this length between the lead-in roll and the first dryer is relatively long. The deflection of the transfer felt upon application of vacuum thereto conforms to a catenary configuration. According to "Standard Handbook For Mechanical Engineers" published by Baumeister & Marks, 8th Edition, chapter 2, pages 36 to 38, the maximum deflection of the transfer felt is a function of (1) the vacuum level, (2) the tension of the transfer felt, and (3) the distance between the supports—that is the lead-in roll and the first dryer.

From the general information taught by the aforementioned handbook, it is evident that if:

Y = the maximum deflection of the transfer felt;

A = the parameter of the catenary in inches;

L = the actual length of the transfer felt between the lead-in roll and the first dryer; then $$Y = A[\mathrm{Cosh}(L/2A) - 1] \quad (1)$$

In order to ascertain the deflection Y, it is necessary to determine the value of the parameter of the catenary A. The value of this parameter A is given from the following equation:

$$A = T/P \quad (2)$$

Where T is the tension applied to the transfer fabric expressed in pounds per linear inch and P is the vacuum produced above the fabric expressed in pounds per square inch.

By combining the equations 1 and 2 as stated hereinbefore, it is possible to determine the deflection from the following equation:

$$Y = (T/P)[\mathrm{Cosh}(LP/2T) - 1] \quad (3)$$

By way of example, in order to illustrate the deflection that would result by the application of a given vacuum level, the following typical figures are provided:

L = 84 inches,

P = 0.018 pounds per square inch,

T = 8 pounds per linear inch.

Using equation (3):

$$Y=(8/0.018)[\mathrm{Cosh}(84\times0.018/2\times8)-1]$$

$$Y=444.44[\mathrm{Cosh}(0.0945)-1]$$

In order to ascertain the value of Y, it is necessary to refer to chapter 1, page 23 of the foregoing handbook which sets forth tables for hyperbolic functions. More particularly, the hyperbolic cosine is determined from the following equation.

$$\mathrm{Cosh}(X)=(e^{x}-e^{-x})/2 \quad (4)$$

According to these tables; Cosh (0.0945)=1.0045, Therefore, from the foregoing: Y=444.44-[Cosh(0.0945)−1]=444.44[1.0045−1], Y=444.44(0.0045), Therefore, Y=1.999 inches.

From the foregoing example, it will be appreciated that the unsupported span of the transfer felt will deflect 2 inches upwardly when the foregoing vacuum is applied above the transfer felt. Such upward deflection of 2 inches could cause the transfer felt to come into contact with the transfer box resulting in damage to the transfer box and rapid wear of the dryer fabric.

In addition to the foregoing problem associated with contact between the box and the transfer felt, another problem exists in that if the transfer box is not adequately sealed relative to the felt near the side edges of the felt, the vacuum level will decrease near the side edges and the web will drop off from the transfer felt at these edges. If stationary seals are provided between the side edges of the transfer box and the side edges of the transfer felt, the aforementioned deflection of the transfer felt will cause contact between the transfer felt and the seals causing both wear to the seals and to the transfer felt.

The present invention overcomes the aforementioned inadequacies of the prior art devices by providing an intermediate support roll between the lead-in felt roll and the first dryer.

Therefore, it is a primary objective of the present invention to provide an apparatus for assisting the transfer of a web by the provision of an intermediate support roll disposed between the lead-in roll and the first dryer for reducing the amount of deflection of the transfer fabric.

Another object of the present invention is the provision of a transfer apparatus including a first transfer box disposed between the lead-in roll and the intermediate roll, the first box being orientated such that a partial vacuum is generated between the first box and the transfer felt for drawing the web into close conformity with the transfer felt between the lead-in roll and the intermediate roll.

Another object of the present invention is the provision of a second transfer box disposed between the intermediate roll and the first dryer with the second box being orientated relative to the transfer felt such that a partial vacuum is generated between the transfer felt and the second box for drawing the web into close conformity with the transfer felt between the intermediate roll and the first dryer so that any tendency of the web to droop relative to the transfer felt is inhibited.

Another object of the present invention is the provision of a transfer apparatus in which the first box includes a first wall which diverges relative to the transfer felt in a direction from the lead-in roll towards the intermediate roll such that during movement of the transfer felt, a partial vacuum is generated between the first wall and the transfer felt for drawing the web into close conformity with the transfer felt.

Another object of the present invention is the provision of a transfer apparatus in which the first box includes a second wall defining a first outlet means such that when the first box is connected to a source of pressurized air, air flows through the first outlet means for doctoring a boundary layer of air away from the rotating intermediate roll and for augmenting the partial vacuum generated between the first wall and the transfer felt.

Another object of the present invention is the provision of a transfer apparatus in which the second transfer box includes a first side which diverges relative to the transfer felt in a direction from the intermediate roll towards the first dryer such that a partial vacuum is generated between the first side and the transfer felt for drawing the web into close conformity with the transfer felt.

Another object of the present invention is the provision of a transfer apparatus in which the first side defines a second outlet means which is disposed adjacent to the first dryer such that when the second box is connected to a source of pressurized air, air flows through the second outlet means so that an under-pressure is generated in the vicinity of the ingoing nip defined by the transfer felt and the first dryer such under-pressure tending to inhibit detachment of the web from the transfer felt in the vicinity of this nip.

Another object of the present invention is the provision of a transfer apparatus including a plurality of air jets disposed adjacent to the intermediate roll for directing a flow of air against the web for supporting the web against the transfer felt, particularly when the tail of the web is being transferred between the press section and the drying section.

Another object of the present invention is the provision of a transfer apparatus in which the second transfer box includes a first side which defines a first and second edge orifice means such that when the second box is connected to a source of pressurized air, air flows from the second box through the first and second edge orifice means for drawing the respective side edges of the web into close conformity with the transfer felt.

Another object of the present invention is the provision of a transfer apparatus in which the second transfer box includes first and second side walls which are connected to the first side adjacent to the first and second edge orifice means with the juncture of the side walls and the first side being beveled such that first and second curtains of air flowing from the respective orifice means flow away from each other in a cross-machine direction and thereafter flow substantially perpendicularly relative to the transfer felt along the respective side walls thereby reducing the possibility of the first and second curtains of air disturbing the tail when it is being transferred between the press section and the dryer section.

Another object of the present invention is the provision of a transfer apparatus in which the first transfer box defines a first and second side orifice means such that when the first transfer box is connected to a source of pressurized air, air flows through the side orifice means for drawing the edges of the web into close conformity with the transfer felt.

Another object of the present invention is the provision of a transfer apparatus in which a single transfer box extends between the lead-in roll and the first dryer. The single transfer box includes a side which defines a first and second edge orifice means which are disposed such that when the transfer box is connected to a source of pressurized air, air flows through the edge orifice means for drawing the web into close conformity with the transfer felt and the side also defines an outlet means extending in a cross-machine direction and disposed adjacent to the first dryer for maintaining the web in close conformity with the transfer felt in the vicinity of the nip defined by the transfer felt and the first dryer.

Other objects and advantages of the present invention will be evident to those skilled in the art by a consideration of the detailed description as stated hereinafter taken in conjunction with the drawings. It should be appreciated by those skilled in the art that various embodiments of the present invention may be made without departing from the spirit and scope of the invention as set forth and defined by the appended claims.

SUMMARY OF THE INVENTION

An apparatus and method for assisting the transfer of a web disposed contiguous relative to a transfer felt such that the web is transferred from a lead-in roll disposed adjacent to a press section, to a first dryer of a papermaking machine dryer section. The apparatus includes an intermediate support roll which is disposed between the lead-in roll and the first dryer such that the transfer felt is disposed between the web and the intermediate roll. A first transfer box is disposed between the lead-in roll and the intermediate roll such that the transfer felt is disposed between the web and the first box. The first transfer box is oriented relative to the transfer felt such that a partial vacuum is generated between the first box and the transfer felt for drawing the web into close conformity with the transfer felt between the lead-in roll and the intermediate roll. A second transfer box is disposed between the intermediate roll and the first dryer such that the transfer felt is disposed between the web and the second box. The second box is oriented relative to the transfer felt such that a partial vacuum is generated between the transfer felt and the second box for drawing the web into close conformity with the transfer felt between the intermediate roll and the first dryer such that any tendency of the web to droop relative to the transfer felt between the lead-in roll and the first dryer is inhibited.

In a more specific embodiment of the present invention, the first transfer box also includes a first wall which is disposed adjacent to the transfer felt. The first wall diverges relative to the transfer felt in a direction from the lead-in roll towards the intermediate roll such that during transfer of the web from the lead-in roll towards the intermediate roll, a partial vacuum is generated between the first wall and the transfer felt for drawing the web into close conformity with the transfer felt. Additionally, the first transfer box includes a second wall which defines a first outlet means disposed adjacent to the intermediate roll. The first transfer box is connected to a source of pressurized air such that air flows from the first transfer box through the first outlet means for doctoring a boundary layer of air away from the intermediate roll during rotation of the intermediate roll. More specifically, the pressurized air flows from the first transfer box through the first outlet means in a direction opposite to the direction of rotation of the intermediate roll for not only doctoring the boundary layer of air away from the rotating intermediate roll, but also to augment the partial vacuum generated between the first wall and the transfer felt.

More specifically, the first transfer box which is of wedge-shaped configuration, shields the web between the lead-in roll and the intermediate roll from disturbing air currents that would otherwise tend to detach the web from the transfer felt. The wedge-shaped configuration generating an underpressure between the first box and the transfer felt assures that the web remains in close conformity with the transfer felt.

The transfer apparatus also includes a second transfer box having a first side disposed adjacent to the transfer felt. The first side diverges relative to the transfer felt in a direction from the intermediate roll towards the first dryer such that during transfer of the web from the intermediate roll towards the first dryer, a partial vacuum is generated between the first side and the transfer felt for drawing the web into close conformity with the transfer felt. The first side defines a second outlet means which is disposed adjacent to the first dryer such that when the second transfer box is connected to a source of pressurized air, air flows from the second box through the second outlet means perpendicularly relative to the direction of movement of the transfer felt and then tangentially relative to the first dryer so that an under-pressure is generated in the vicinity of the ingoing nip defined by the transfer felt and the first dryer. The under-pressure tends to inhibit detachment of the web from the transfer felt in the vicinity of this nip.

In one embodiment of the present invention, a plurality of air jets are disposed adjacent to the intermediate roll such that the web and transfer felt are disposed between the plurality of jets and the intermediate roll. The plurality of air jets support the web in the cross-machine direction as the jets direct a flow of air against the web for supporting the web against the transfer felt, particularly when the tail of the web is being transferred between the press section and dryer section.

In a particular embodiment of the present invention, the second box includes first and second edge orifice means for directing a first and second curtain of air away from each other in the cross-machine direction for maintaining the respective edges of the web in close conformity with the transfer felt.

In a further embodiment of the present invention, the first transfer box includes a first wall which defines a first and second side orifice means which is disposed such that when the first transfer box is connected to a source of pressurized air, air flows through the respective side orifice means for drawing the side edges of the web into close conformity with the transfer felt.

In a further embodiment of the present invention, when the distance between the lead-in roll and the first dryer is relatively small, a single transfer box is used which extends between the lead-in roll and the first dryer. This single transfer box includes a side which defines a first and second edge orifice means such that when the transfer box is connected to a source of pressurized air, air flows through the edge orifice means for drawing the edges of the web into close conformity with the transfer felt. The side of the transfer box also defines an outlet means which is disposed adjacent to the first dryer and which extends in a cross-machine direction such that when the transfer box is connected to a source of pressurized air, air flows from the transfer box through the outlet means in a direction initially perpendicularly relative to the first dryer and, thereafter, tangentially relative to the first dryer and in the same direction as the direction of movement of the transfer felt thereby decreasing the air pressure in the vicinity of the nip defined by the transfer felt and the first dryer and inhibiting detachment of the web from the transfer felt in the vicinity of this nip.

Although the present invention, as described hereinafter relates to particular embodiments for carrying out the concept of the present invention, it should be appreciated by those skilled in the art that many alternative embodiments and variations and modifications may be made without departing from the spirit and scope of the present invention defined by the appended claims. Particularly, this invention finds application not only in transferring a paper web between a pressing and drying section, but also the transfer of any other sheet-like material transferred by means of a pervious transfer fabric.

BRIEF DESCRIPTION OF THE DRAWINGS

FIG. 6 is a fragmentary perspective view of the second box shown in FIG. 3 showing the side wall being beveled relative to the first side.

FIG. 7 is a graph indicating how the induced vacuum varies in accordance with the distance of the second outlet means from the first dryer.

Similar reference characters refer to similar parts throughout the various embodiments of the present invention.

DETAILED DESCRIPTION OF THE DRAWINGS

Figure 1:
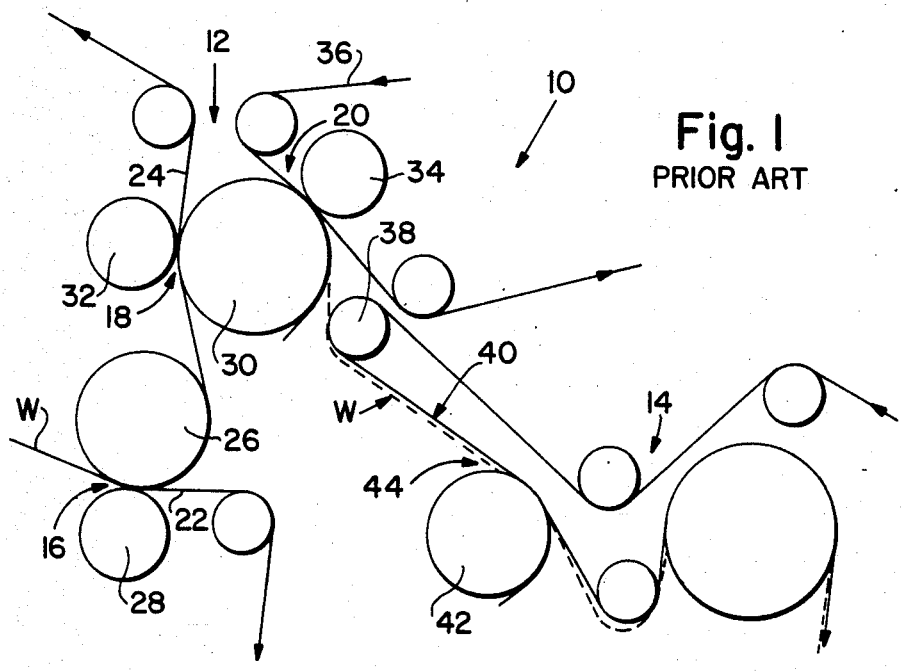
Fig. 1 PRIOR ART
FIG. 1 is a side elevational view of a prior art press section, dryer section and transfer apparatus showing the web being transferred between the press section and the dryer section.

FIG. 1 is a side elevational view of a typical prior art transfer apparatus generally designated 10 for transferring a web W from a press section generally designated 12 to a dryer section generally designated 14. The press section 12 includes three pressing nips 16, 18 and 20. The web W supported between a bottom felt 22 and a top felt 24 is guided between the first nip 16 defined by a first and second cooperating press roll 26 and 28 respectively. The web W separates from the bottom felt 22 and follows the top felt 24 around the press roll 26. The web W continues through the second nip 18 defined by a third and fourth cooperating press roll 30 and 32 respectively. The web W separates from the top felt 24 and continues around the third press roll 30 between the third nip 20 defined by the third press roll 30 and a fifth press roll 34. A third press felt 36 extends through the third nip 20 such that the web W is sandwiched between the third press felt 36 and the roll 30. The web W emerges from the third nip 20 and extends around a lead-in roll 38 such that the web W travels contiguous with a transfer felt 40 extending between the lead-in roll 38 and a first dryer 42 of the dryer section 14.

As will be appreciated by those skilled in the art, although the lead-in roll 38 is generally disposed as close as possible to the third press roll 30 the span that the web W must traverse between the lead-in roll 38 and the nip 44 defined by the transfer felt 40 and the first dryer 42 is considerable. Problems have existed in the prior art apparatus of the aforementioned type in that there is a tendency of the web W to droop relative to the transfer felt 40 between the lead-in roll 38 and the first dryer 42. In an attempt to overcome the problem of the web W becoming detached from the transfer felt 40, various proposals have been set forth in the prior art.

Figure 2:
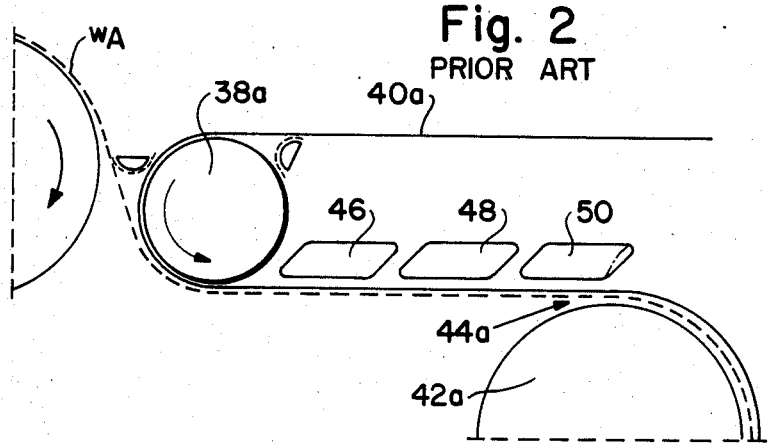
Fig. 2 PRIOR ART
FIG. 2 is a side elevational view of a prior art transfer box.

FIG. 2 is a side elevational view of a prior art blow box arrangement wherein a plurality of blow boxes 46, 48,50 are disposed above the transfer felt 40*a* in order to create a negative pressure above the transfer felt 40*a* to draw the web Wa into close contact with the transfer felt 40*a* until the web Wa passes through the nip 44*a*. However, with this prior art device, due to the considerable span between the lead-in roll 38*a* and the first dryer 42*a*, if a sufficient vacuum is applied above the transfer felt 40*a* in order to prevent drooping of the web Wa at high speeds, the required vacuum is such that the transfer felt 40*a* is drawn upwardly into physical contact with one or more of the blow boxes 46, 48 or 50 causing damage to the blow boxes and considerable wear to the transfer felt 40*a*.

Figure 3:
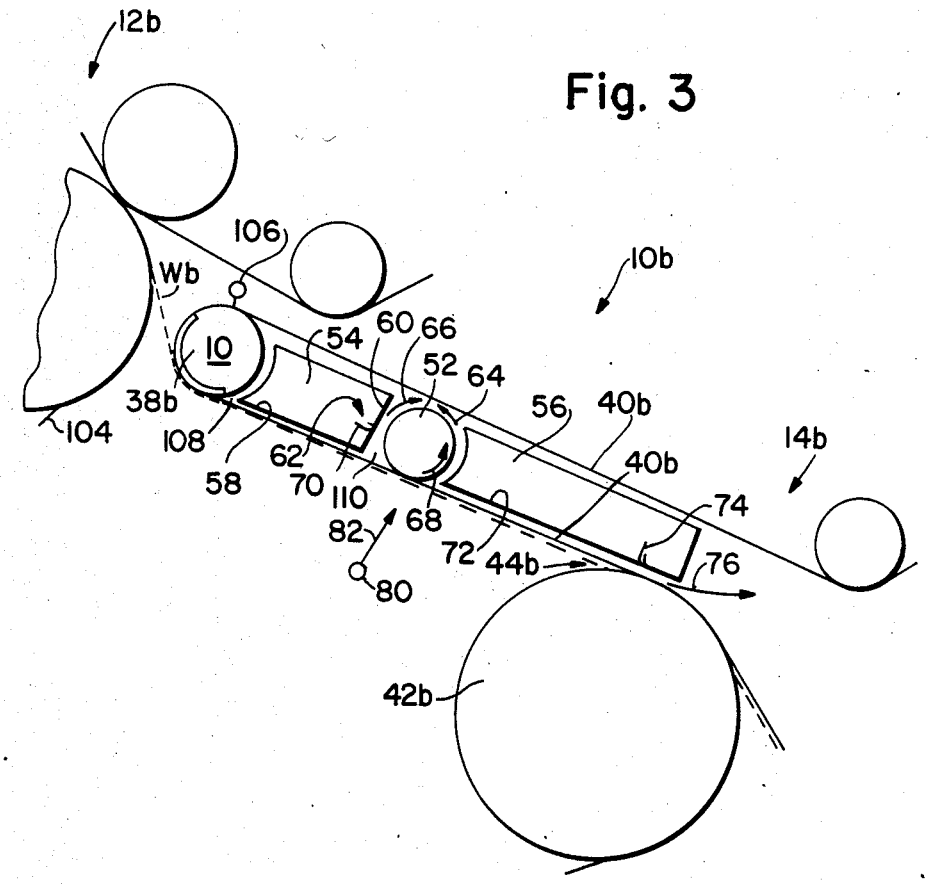
FIG. 3 is a side elevational view of the transfer apparatus according to the present invention.
Figure 4:
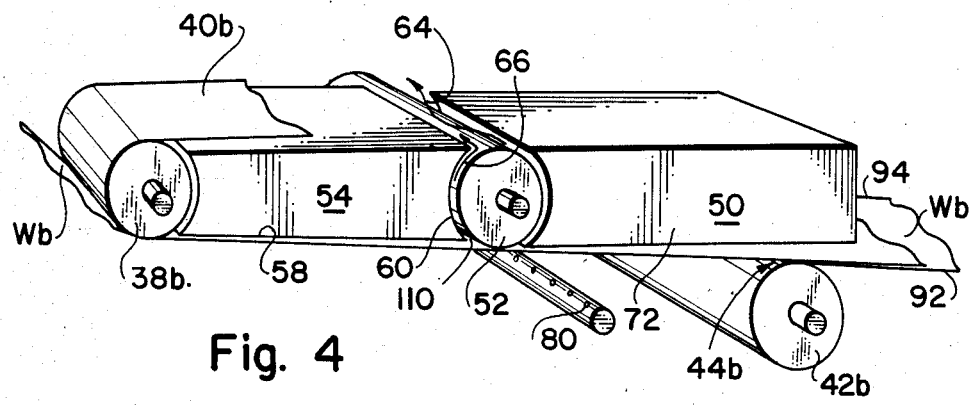
FIG. 4 is a perspective view of the transfer apparatus as shown in FIG. 3.
Figure 5:
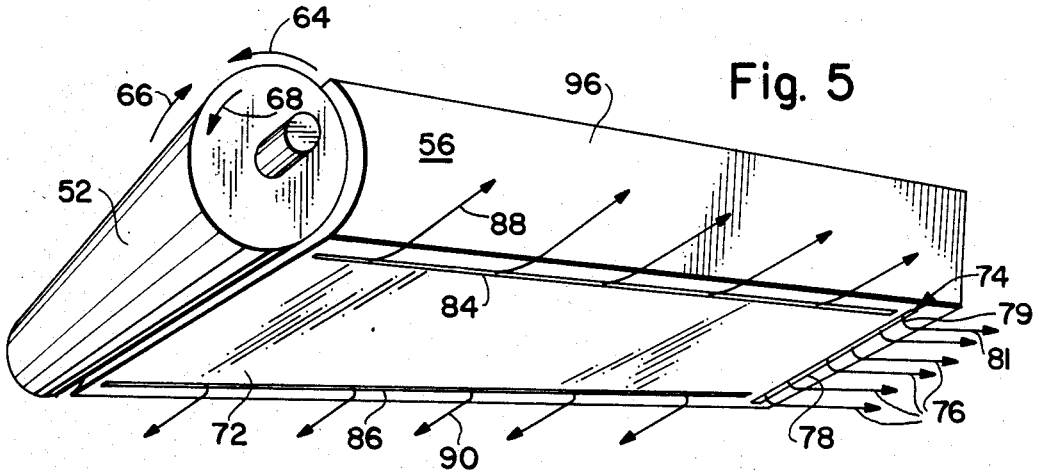
FIG. 5 is a perspective view from beneath the second transfer box showing the disposition of the intermediate roll and the location of the second outlet means and the first and second edge orifice means.

The aforementioned problem is overcome by the present invention which is shown in FIGS. 3–5. The embodiment of FIGS. 3–5 includes a transfer apparatus generally designated 10*b* for assisting the transfer of the web Wb which is disposed contiguous relative to a transfer felt 40*b*. The web Wb is transferred from a lead-in roll 38*b* disposed adjacent to a press section 12*b*, to a first dryer 42*b* of a papermaking machine dryer section generally designated 14*b*. The apparatus 10*b* includes an intermediate support roll 52 which is disposed between the lead-in roll 38*b* and the first dryer 42*b* such that the transfer felt 40*b* is disposed between the web Wb and the intermediate roll 52. A first transfer box 54 is disposed between the lead-in roll 38*b* and the intermediate roll 52 such that the transfer felt 40*b* is disposed between the web Wb and the first box 54. The first box 54 is orientated relative to the transfer felt 40*b* such that a partial vacuum is generated between the first box 54 and the transfer felt 40*b* for drawing the web Wb into close conformity with the transfer felt 40*b* between the lead-in roll 38*b* and the intermediate roll 52. A second transfer box 56 is disposed between the intermediate roll 52 and the first dryer 42*b* such that the transfer felt 40*b* is disposed between the web Wb and the second box 56. The second box 56 is oriented relative to the transfer felt 40*b* such that a partial vacuum is generated between the transfer felt 40*b* and the second box 56 for drawing the web Wb into close conformity with the transfer felt 40*b* between the intermediate roll 52 and the first dryer 42*b* such that any tendency of the web Wb to droop relative to the transfer felt 40b between the lead-in roll 38b and the first dryer 42b is inhibited.

Figure 5A:
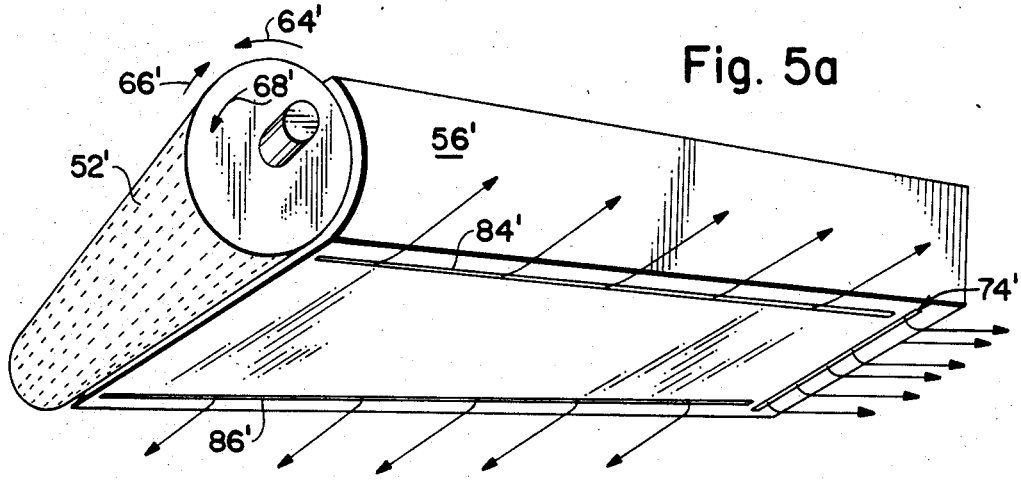
FIG. 5*a* is a similar view to that shown in FIG. 5 but shows the grooved intermediate roll replaced by a vacuum roll.

In the embodiment of the present invention shown in FIGS. 3–5, the intermediate roll 52 is a grooved roll. However, in an alternative embodiment of the present invention as shown in FIG. 5a the intermediate roll is a vacuum roll 52'.

In each of the embodiments shown in FIGS. 3,4,5 and 5a the intermediate roll supports the transfer felt midway between the lead-in roll and the first dryer.

As shown in FIGS. 3–5, the first transfer box 54 also includes a first wall 58 which is disposed adjacent to the transfer felt 40b. The first wall 58 diverges relative to the transfer felt 40b in a direction from the lead-in roll 38b towards the intermediate roll 52 such that during transfer of the web Wb from the lead-in roll 38b towards the intermediate roll 52 a partial vacuum is generated between the first wall 58 and the transfer felt 40b for drawing the web Wb into close conformity with the transfer felt 40b. The first transfer box 54 also includes a second wall 60 which defines a first outlet means generally designated 62 which is disposed adjacent to the intermediate roll 52. The first box 54 is also connected to a source of pressurized air (not shown) such that air flows from the first transfer box 54 through the first outlet means 62 for doctoring a boundary layer of air indicated by the arrow 64 away from the intermediate roll 52 during rotation of the intermediate roll 52. As shown in FIGS. 3–5, the air as indicated by the arrow 66 flows through the first outlet means 62 in a direction opposite to the direction of rotation 68 of the intermediate roll 52 for firstly doctoring the boundary layer of air 64 away from the rotating intermediate roll 52 and secondly for augmenting the partial vacuum generated between the first wall 58 and the transfer felt 40b.

The first transfer box 54 shields the web Wb between the lead-in roll 38b and the intermediate roll 52 from disturbing air currents (not shown) that would otherwise tend to detach the web Wb from the transfer felt 40b. The first box 54 is of wedge-shaped configuration for generating an under-pressure between the first box 54 and the transfer felt 40b. This under-pressure assures that the web Wb remains in close conformity with the transfer felt 40b.

More particularly, as shown in FIG. 3, the first outlet means 62 includes first nozzle means 70 for directing the air 66 in a direction opposite to the direction of rotation 68 of the intermediate roll 52. The Coanda Effect is utilized to direct the air 66 substantially perpendicularly to the direction of movement of the transfer felt 40b. The air, as indicated by the arrow 66 moves perpendicularly relative to the movement of the transfer felt 40b and extends substantially along the entire width of the web Wb such that lifting of the web Wb from the transfer felt 40b is inhibited by such perpendicular flow of air.

As shown in FIGS. 3–4, and more particularly with reference to FIG. 5, the second transfer box 56 also includes a first side 72 which is disposed adjacent to the transfer felt 40b. The first side 72 diverges relative to the transfer felt 40b in a direction from the intermediate roll 52 towards the first dryer 42b such that during transfer of the web Wb from the intermediate roll 52 towards the first dryer 42b a partial vacuum is generated between the first side 72 and the transfer felt 40b for drawing the web Wb into close conformity with the transfer felt 40b.

As shown in FIGS. 3–5, the first side 72 defines a second outlet means generally designated 74 which is disposed adjacent to the first dryer 42b such that when the second transfer box 56 is connected to a source of pressurized air (not shown) air flows from within the second transfer box 56 through the second outlet means 74 as shown by the arrows 76. The air 76 flows perpendicularly relative to the direction of movement of the transfer felt 40b and then tangentially relative to the first dryer 42b so that an under-pressure is generated in the vicinity of the ingoing nip 44b defined by the transfer felt 40b and the first dryer 42b. This under-pressure tends to inhibit detachment of the web Wb from the transfer felt 40b in the vicinity of the nip 44b.

More particularly, the second outlet means 74 includes second nozzle means 78 for initially directing the air 76 radially relative to the first dryer 42b as indicated by 79. The Coanda Effect is utilized to thereafter direct the air 76 tangentially relative to the first dryer 42b as shown by the component 81. As the air 76 is directed tangentially relative to the first dryer 42b along substantially the entire width of the web Wb as shown in FIG. 5, lifting of the web Wb from the transfer felt 40b in the vicinity of the nip 44b is inhibited.

As shown in FIGS. 3–4, a plurality of air jets 80 are disposed adjacent to the intermediate roll 52 such that the web Wb and transfer felt 40b are disposed between the plurality of jets 80 and the intermediate roll 52. The plurality of jets 80 support the web Wb in the cross-machine direction. The plurality of jets 80 direct a flow of air as indicated by the arrow 82 against the web Wb for supporting the web Wb against the transfer felt 40b particularly when the tail (not shown) of the web Wb is being transferred between the press section 12b and the dryer section 14b. The plurality of air jets 80 are supplied with pressurized air such that the web Wb is supported in the cross-machine direction regardless of the width of the web Wb.

As shown in FIG. 5, the second transfer box 56 includes the first side 72 which is disposed adjacent to the transfer felt 40b and this first side 72 defines a first and a second edge orifice means 84 and 86 respectively such that when the second transfer box 56 is connected to a source of pressurized air, air as indicated by the arrows 88 and 90 flows from the second transfer box 56 through respectively, the first and second edge orifice means 84 and 86 for drawing the respective edges 92 and 94 of the web Wb into close conformity with the transfer felt 40b as shown in FIG. 6. The first and second edge orifice means 84 and 86 respectively, utilize the Coanda Principle to direct a first and second curtain of air as indicated by the arrows 88 and 90 respectively, away from each other in the cross-machine direction for maintaining the respective edges 92 and 94 of the web in close conformity with the transfer felt 40b. The first and second curtains of air 88 and 90 extend substantially between the intermediate roll 52 and the first dryer 42b.

As shown in FIG. 6, the second transfer box 56 also includes a first and a second side wall 96 and 98 respectively. The first and second side walls 96 and 98 are connected to the first side 72 adjacent to the first and second edge orifice means 84 and 86 respectively. The junctures 100 and 102 of the first and second side walls 96 and 98 with the first side 72 are beveled such that the first and second curtains of air 88 and 90 flow from the first and second edge orifice means 84 and 86 respectively, away from each other in a cross-machine direction and thereafter flow substantially perpendicularly relative to the transfer felt 40b along the first and second side walls 96 and 98 respectively thereby reducing the possibility of the first and second curtains of air 88 and 90 disturbing the tail (not shown) when it is being transferred between the press section 12b and the dryer section 14b.

In operation of the transfer apparatus, in order to begin transfer of the web from the press section to the dryer section, the pressed web is continuously doctored from the third press roll 30 by a doctor 104 as shown in FIG. 3. An air jet (not shown) is used to separate a tail 2 to 6 inches wide and this tail is lifted from the press roll 30 by air jet manual handling means (not shown) such that the tail is directed past the lead-in roll 38b along the transfer felt 40b towards the nip 44b. During guidance of the tail towards the nip 44b a flow of air is directed from the plurality of air jets 80 such that the narrow tail is blown upwardly into conformity with the transfer felt 40b. Due to the diverging first wall 58 and first side 72 of the boxes 54 and 56 respectively, an under-pressure above the transfer felt 40b tends to draw the tail upwardly against the transfer felt 40b. However, this upward drawing of the tail is greatly assisted by the plurality of air jets 80 as often the under-pressure above the transfer felt 40b is not sufficient to maintain the tail in close conformity with the transfer felt 40b.

As the tail is threaded through the dryer section 14b the width of the tail is increased progressively until the full width of the web Wb is being transferred from the press section 12b to the dryer section 14b. In the prior art devices, due to the considerable span between the lead-in roll and the first dryer, there has been a tendency of the transfer felt to bow upwardly as the under-pressure (or vacuum) above the transfer felt is increased. Such upward bowing of the transfer felt has limited the amount of under-pressure (or vacuum) that might be applied above the transfer felt because if the under-pressure is increased to the required level, the transfer felt comes into physical contact with one or more of the transfer boxes. The present invention overcomes this difficulty by providing the intermediate roll 52 which greatly reduces the span, or unsupported distance, that the transfer felt must travel unsupported. For example, by placing the intermediate support roll 52 as shown in FIG. 3, midway between the lead-in roll 38b and the first dryer 42b the unsupported span between the lead-in roll 38b and the first dryer 42b is reduced from 84 inches to 42 inches. That is, the distance between the lead-in roll 38b and the intermediate roll 52 is 42 inches and the distance between the intermediate roll 52 and the first dryer 42b is also 42 inches. By substituting in the equation (3) as mentioned hereinbefore, the span 42 inches instead of the span 84 inches, the deflection undergone by the transfer felt between the lead-in roll 38b and the intermediate roll 52 is 0.5 inches when the same tension of 8 psi exists and a vacuum level of 0.018 psi is maintained in the first transfer box 54. This deflection of 0.5 inches is determined by utilizing the equation:

$$Y=T/P[\mathrm{Cosh}(LP/2T)-1] \quad (3)$$

Wherein:

$Y=8/0.018[\mathrm{Cosh}(42\times0.018/2\times8)-1]$ $Y=444.44[\mathrm{Cosh}(0.04725)-1]$ $Y=444.44[1.001-1]$ Therefore, $Y=444.44\times0.001$ which $=0.444$ inches, or approximately ½ inch.

From these figures it will be readily evident that by reducing the unsupported span of the transfer felt by one-half, that is from 84 inches to 42 inches, the deflection of the transfer felt is reduced four-fold. That is from 2 inches down to ½ inch. This means that if the 2 inch deflection were acceptable and would not cause fouling of the transfer box, then it would be possible to increase the vacuum below the transfer box from 0.018 psi to 0.072 psi which represents an increased vacuum from 0.5 inches water column to 2 inches water column. By having the span halved therefore, the vacuum level may be increased by a factor of 4. Such increased vacuum is highly desirable in order to avoid any possibility of the web from falling away or drooping relative to the transfer felt. Although the foregoing equation (3) has been applied to the first transfer box 54, the same principle applies to the second transfer box 56 which similarly may have applied thereto means to generate a vacuum which is four times the level of the vacuum that would be acceptable in the absence of the intermediate support roll 52.

The utliization of the aforementioned increased vacuum means is particularly useful adjacent to the first dryer 42b because it has been proven experimentally that the tendency to droop relative to the transfer felt 40b usually originates at the nip 44b and then extends upstream towards the lead-in roll 38b.

The lead-in roll 38b is preferably a vacuum roll but could alternatively be a grooved roll or a plain roll. The roll 38b is provided with an air deflector 106 as shown in FIG. 3. The lead-in roll 38b supports both the fabric 40b and the web Wb and should produce a slight vacuum at the diverging nip 108 in order to hold the web Wb against the transfer felt 40b.

In addition to the under-pressure developed by the transfer felt 40b and the diverging first wall 58 of the first box 54 such under-pressure (or vacuum) is augmented by the flow of air 66 which induces an increased under-pressure, or vacuum, in the nip area 110 defined by the intermediate roll 52 and the transfer felt 40b. Such vacuum prevents the web from being lifted off of the transfer felt 40b by the intermediate roll 52 and additionally, the flow of air 66 doctors the boundary layer of air 64 off of the rotating intermediate roll 52 as shown in FIG. 4.

The second transfer box 56 also has a first side 72 which diverges relative to the transfer felt 40b for creating a partial vacuum above the transfer felt 40b. In practice, the angle of divergence of both the first wall 58 and the first side 72 is within the range 1 to 2 degrees and this divergence has been found sufficient to maintain the necessary under-pressure above the transfer felt 40b.

As shown in FIG. 7, the flow of air 76 flowing from the second box 56 adjacent to the first dryer 42b reaches a peak vacuum when the second outlet means 74 is disposed adjacent to the nip 44b defined by the first dryer 42b and the transfer felt 40b. This peak vacuum has been found to be advantageous in preventing the separation of the web Wb from the transfer felt 40b which usually begins at this nip 44b and propagates towards the wet end.

Although, in the prior art, air jets have been utilized to assist in threading a tail from a press to a dryer section, the present invention enables the support of the web along the entire cross-machine direction. That is, the plurality of jets 80 support a narrow, 2 inch tail and progressively support the web until the web extends across the full width of the transfer apparatus.

The first and second edge orifice means 84 and 86 defined by the second box 56 are particularly useful for holding the edges 92 and 94 of the web Wb in close conformity with the transfer felt 40*b*. By providing beveled junctures 100 and 102, the first and second curtains of air 88 and 90 flow outwardly away from each other in a cross-machine direction and then tend to follow the first and second side walls 96 and 98 respectively thereby creating a suction effect in the vicinity of the edges 92 and 94 of the web Wb. This effect prevents the respective edges of the web Wb from detecting from the transfer felt 40*b*.

Figure 8:
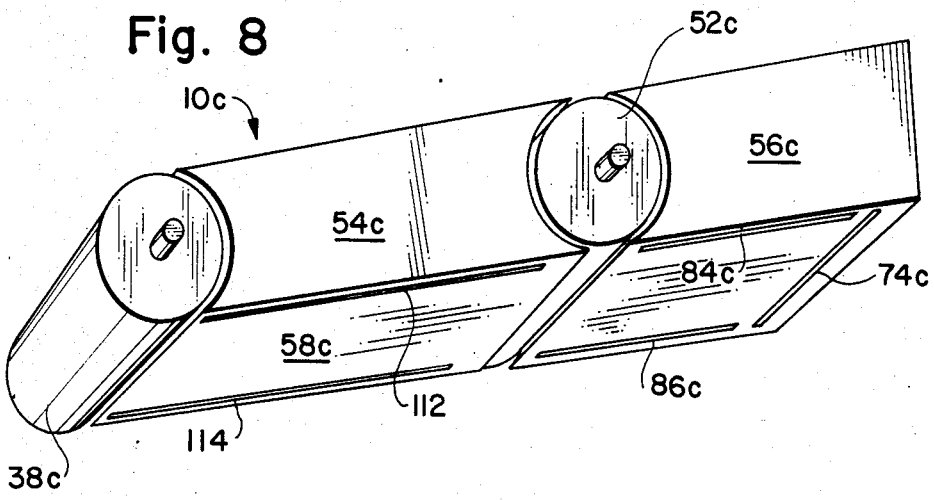
FIG. 8 is a perspective view of a second embodiment of the present invention in which the first transfer box defines edge orifice means.

FIG. 8 shows an alternative embodiment of the present invention which is similar to the embodiment shown in FIG. 3. Similar reference numerals are used to indicate corresponding parts to that shown in the embodiment of FIG. 3, however, the suffix c has been added thereto.

FIG. 8 shows a transfer apparatus generally designated 10*c* including a lead-in roll 38*c* and a first transfer box 54*c* disposed adjacent to the lead-in roll 38*c*. The first transfer box 54*c* includes a first wall 58*c* which defines a first and second side orifice means 112 and 114 respectively. The first and second side orifice means 112 and 114 are disposed adjacent to the side edges of the first transfer box 54*c* such that when the first transfer box 54*c* is connected to a source of pressurized air, air flows from the first transfer box 54*c* through, respectively, the orifice means 112 and 114 for drawing the respective side edges of the web into close conformity with the transfer felt. In other respects, the embodiment shown in FIG. 8 is identical to the embodiment shown in FIG. 3 with the second transfer box 56*c* defining first and second edge orifice means 84*c* and 86*c* respectively.

Figure 9:
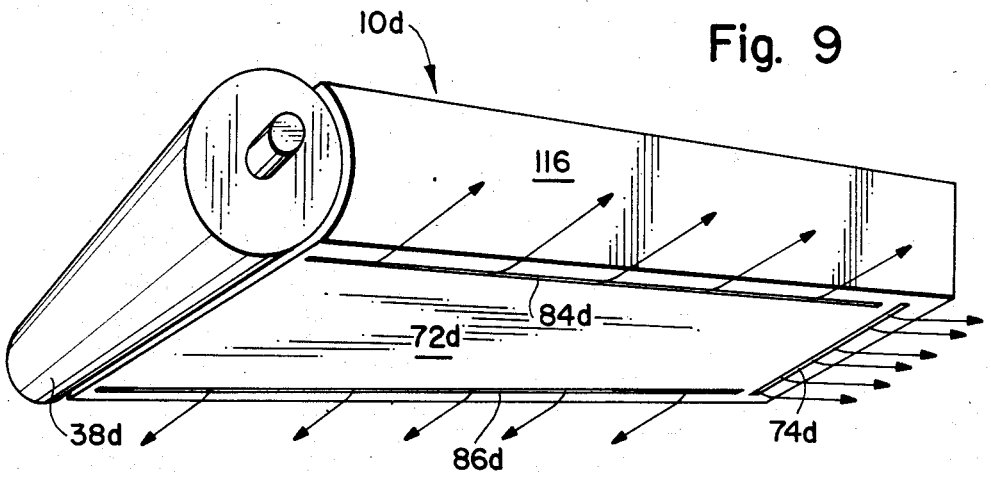
FIG. 9 is a perspective view of a third embodiment of the present invention in which the intermediate roll is dispensed with and the sole transfer box includes edge orifice means and outlet means adjacent to the first dryer.

FIG. 9 shows a third embodiment of the present invention in which a transfer apparatus generally designated 10*d* includes a lead-in roll 38*d* and transfer box 116 which extends between the lead-in roll 38*d* and the first dryer (not shown). The first dryer is disposed adjacent to an outlet means 74*d*. The outlet means 74*d* is disposed adjacent to the first dryer such that when the transfer box 116 is connected to a source of pressurized air, air flows from within the transfer box 116 through the outlet means 74*d* perpendicularly relative to the direction of movement of the transfer felt and thereafter, tangentially relative to the first dryer so that an under-pressure is generated in the vicinity of the ingoing nip defined by the transfer felt and the first dryer. This under-pressure tends to inhibit detachment of the web from the transfer felt in the vicinity of this nip.

The transfer box 116 includes a side 72*d* which is disposed adjacent to the transfer felt. The side 72*d* diverges relative to the transfer felt in a direction from the lead-in roll 38*d* towards the first dryer such that during transfer of the web from the lead-in roll 38*d* towards the first dryer, a partial vacuum is generated between the side 72*d* and the transfer felt for drawing the web into close conformity with the transfer felt.

The side 72*d* defines a first and and second edge orifice means 84*d* and 86*d* respectively. The edge orifice means 84*d* and 86*d* are disposed such that when the transfer box 116 is connected to a source of pressurized air, air flows from the transfer box 116 through respectively the first and second edge orifice means 84*d* and 86*d* for drawing the respective side edges of the web into close conformity with the transfer felt.

In operation of the embodiment shown in FIG. 8, the inclusion of the first and second edge orifice means 112 and 114 operate to maintain the web edges closely against the transfer felt.

In operation of the embodiment shown in FIG. 9, when a relatively short span between the lead-in roll 38*d* and the first dryer is the case, the provision of a single transfer box 116 is found to be sufficient. The transfer box 116 generates an under-pressure between the side 72*d* and the transfer felt for drawing the web into close conformity with the transfer felt. The first and second edge orifice means 84*d* and 86*d* draw the edges of the web into close conformity with the transfer felt and the orifice means 74*d* which extends in a cross-machine direction, inhibits detachment of the web, or tail, in the vicinity of the nip defined by the transfer felt and the first dryer.

The present invention enables a four-fold increase in the under-pressure maintained above the transfer felt, thereby preventing detachment of the web from the transfer felt. Such four-fold increase in vacuum is attainable by the provision of an intermediate support roll. Furthermore, such vacuum is attainable by the provision of transfer boxes which diverge relative to the transfer felt, such vacuum being augmented by air flowing out of the transfer boxes. Also the edge orifice means are used to insure that the edges of the web do not detach from the felt and a plurality of air nozzles assist particularly in the threading of a tail between the press and dryer sections.

Although the foregoing embodiments have been described relative to an arrangement having a relatively large span between the lead-in roll and first dryer, it should be appreciated that if a relatively small span exists between the lead-in roll and the first dryer, the intermediate roll may be dispensed with.

What is claimed is:

1. An apparatus for assisting the transfer of a web disposed contiguous relative to a transfer felt such that the web is transferred from a lead-in roll disposed adjacent to a press section to a first dryer of a papermaking machine dryer section, said apparatus comprising:

an intermediate support roll disposed between the lead-in roll and the first dryer such that the transfer felt is disposed between the web and said intermediate roll;

a first transfer box disposed between the lead-in roll and said intermediate roll such that the transfer felt is disposed between the web and said first box, said first transfer box being oriented relative to the transfer felt such that a partial vacuum is generated between said first box and the transfer felt for drawing the web into close conformity with the transfer felt between the lead-in roll and said intermediate roll; and a second transfer box disposed between said intermediate roll and the first dryer such that the transfer felt is disposed between the web and said second box, said second box being oriented relative to the transfer felt such that a partial vacuum is generated between the transfer felt and said second box for drawing the web into close conformity with the transfer felt between said intermediate roll and the first dryer such that any tendency of the web to droop relative to the transfer felt between the lead-in roll and the first dryer is inhibited.

2. An apparatus as set forth in claim 1 wherein said intermediate roll is a grooved roll.

3. An apparatus as set forth in claim 1 wherein said intermediate roll is a vacuum roll.

4. An apparatus as set forth in claim 1 wherein said intermediate roll supports the transfer felt midway between the lead-in roll and the first dryer.

5. An apparatus for assisting the transfer of a web disposed contiguous relative to a transfer felt such that the web is transferred from a lead-in roll disposed adjacent to a press section to a first dryer of a papermaking machine dryer section, said apparatus comprising:

an intermediate support roll disposed between the lead-in roll and the first dryer such that the transfer felt is disposed between the web and said intermediate roll;

a first transfer box disposed between the lead-in roll and said intermediate roll such that the transfer felt is disposed between the web and said first box, said first transfer box being oriented relative to the transfer felt such that a partial vacuum is generated between said first box and the transfer felt for drawing the web into close conformity with the transfer felt between the lead-in roll and said intermediate roll;

a second transfer box disposed between said intermediate roll and the first dryer such that the transfer felt is disposed between the web and said second box, said second box being oriented relative to the transfer felt such that a partial vacuum is generated between the transfer felt and said second box for drawing the web into close conformity with the transfer felt between said intermediate roll and the first dryer such that any tendency of the web to droop relative to the transfer felt between the lead-in roll and the first dryer is inhibited; and said first transfer box further including:

a first wall disposed adjacent to the transfer felt, said first wall diverging relative to the transfer felt in a direction from the lead-in roll towards said intermediate roll such that during transfer of the web from the lead-in roll towards said intermediate roll, a partial vacuum is generated between said first wall and the transfer felt for drawing the web into close conformity with the transfer felt.

6. An apparatus for assisting the transfer of a web disposed contiguous relative to a transfer felt such that the web is transferred from a lead-in roll disposed adjacent to a press section to a first dryer of a papermaking machine dryer section, said apparatus comprising:

an intermediate support roll disposed between the lead-in roll and the first dryer such that the transfer felt is disposed between the web and said intermediate roll;

a first transfer box disposed between the lead-in roll and said intermediate roll such that the transfer felt is disposed between the web and said first box, said first transfer box being oriented relative to the transfer felt such that a partial vacuum is generated between said first box and the transfer felt for drawing the web into close conformity with the transfer felt between the lead-in roll and said intermediate roll;

a second transfer box disposed between said intermediate roll and the first dryer such that the transfer felt is disposed between the web and said second box, said second box being oriented relative to the transfer felt such that a partial vacuum is generated between the transfer felt and said second box for drawing the web into close conformity with the transfer felt between said intermediate roll and the first dryer such that any tendency of the web to droop relative to the transfer felt between the lead-in roll and the first dryer is inhibited and; said first transfer box further including:

a second wall defining a first outlet means disposed adjacent to said intermediate roll, said first transfer box being connected to a source of pressurized air such that air flows from said first transfer box through said first outlet means for doctoring a boundary layer of air away from said intermediate roll during rotation of said intermediate roll.

7. An apparatus as set forth in claim 5 wherein said first transfer box further includes:

a second wall defining a first outlet means disposed adjacent to said intermediate roll, said first transfer box being connected to a source of pressurized air such that air within the first transfer box flows from said first transfer box through said first outlet means in a direction opposite to the direction of rotation of said intermediate roll for firstly doctoring a boundary layer of air away from said rotating intermediate roll and secondly, to augment the partial vacuum generated between said first wall and the transfer felt.

8. An apparatus for assisting the transfer of a web disposed contiguous relative to a transfer felt such that the web is transferred from a lead-in roll disposed adjacent to a press section to a first dryer of a papermaking machine dryer section, said apparatus comprising:

an intermediate support roll disposed between the lead-in roll and the first dryer such that the transfer felt is disposed between the web and said intermediate roll;

a first transfer box disposed between the lead-in roll and said intermediate roll such that the transfer felt is disposed between the web and said first box, said first transfer box being oriented relative to the transfer felt such that a partial vacuum is generated between said first box and the transfer felt for drawing the web into close conformity with the transfer felt between the lead-in roll and said intermediate roll;

a second transfer box disposed between said intermediate roll and the first dryer such that the transfer felt is disposed between the web and said second box, said second box being oriented relative to the transfer felt such that a partial vacuum is generated between the transfer felt and said second box for drawing the web into close conformity with the transfer felt between said intermediate roll and the first dryer such that any tendency of the web to droop relative to the transfer felt between the lead-in roll and the first dryer is inhibited and;

said first transfer box shielding the web between the lead-in roll and said intermediate roll from disturbing air currents that would otherwise tend to detach the web from the transfer felt, said first box having a wedge-shaped configuration for generating an under-pressure between said first box and the transfer felt, said under-pressure assuring that the web remains in close conformity with the transfer felt.

9. An apparatus as set forth in claim 7 wherein said first outlet means includes:

first nozzle means for directing the air in a direction opposite to the direction of rotation of said intermediate roll, the Coanda Effect being utilized to direct the air substantially perpendicularly to the direction of movement of the transfer felt.

10. An apparatus as set forth in claim 9 wherein the air is directed perpendicularly to the direction of movement of the transfer felt and away from the web along substantially the entire width of the web such that lifting of the web from the transfer felt is inhibited by the perpendicular flow of air.

11. An apparatus for assisting the transfer of a web disposed contiguous relative to a transfer felt such that the web is transferred from a lead-in roll disposed adjacent to a press section to a first dryer of a papermaking machine dryer section, said apparatus comprising:

an intermediate support roll disposed between the lead-in roll and the first dryer such that the transfer felt is disposed between the web and said intermediate roll;

a first transfer box disposed between the lead-in roll and said intermediate roll such that the transfer felt is disposed between the web and said first box, said first transfer box being oriented relative to the transfer felt such that a partial vacuum is generated between said first box and the transfer felt for drawing the web into close conformity with the transfer felt between the lead-in roll and said intermediate roll;

a second transfer box disposed between said intermediate roll and the first dryer such that the transfer felt is disposed between the web and said second box, said second box being oriented relative to the transfer felt such that a partial vacuum is generated between the transfer felt and said second box for drawing the web into close conformity with the transfer felt between said intermediate roll and the first dryer such that any tendency of the web to droop relative to the transfer felt between the lead-in roll and the first dryer is inhibited and; said second transfer box further including:

a first side disposed adjacent to the transfer felt, said first side diverging relative to the transfer felt in a direction from said intermediate roll towards the first dryer such that during transfer of the web from said intermediate roll towards the first dryer, a partial vacuum is generated between said first side and the transfer felt for drawing the web into close conformity with the transfer felt.

12. An apparatus as set forth in claim 11 wherein said first side defines a second outlet means disposed adjacent to the first dryer such that when said second transfer box is connected to a source of pressurized air, air flows from within said second transfer box through said second outlet means perpendicularly relative to the direction of movement of the transfer felt so that an under-pressure is generated in the vicinity of the ingoing nip defined by the transfer felt and the first dryer, said under-pressure tending to inhibit detachment of the web from the transfer felt in the vicinity of said nip.

13. An apparatus as set forth in claim 12 wherein said second outlet means includes:

second nozzle means for initially directing the air radially relative to the first dryer, the Coanada Effect being utilized to thereafter direct the air tangentially relative to the first dryer.

14. An apparatus as set forth in claim 13 wherein the air is directed tangentially relative to the first dryer along substantially the entire width of the web such that lifting of the web from the transfer felt in the vicinity of said nip is inhibited.

15. An apparatus for assisting the transfer of a web disposed contiguous relative to a transfer felt such that the web is transferred from a lead-in roll disposed adjacent to a press section to a first dryer of a papermaking machine dryer section, said apparatus comprising:

an intermediate support roll disposed between the lead-in roll and the first dryer such that the transfer felt is disposed between the web and said intermediate roll;

a first transfer box disposed between the lead-in roll and said intermediate roll such that the transfer felt is disposed between the web and said first box, said first transfer box being oriented relative to the transfer felt such that a partial vacuum is generated between said first box and the transfer felt for drawing the web into close conformity with the transfer felt between the lead-in roll and said intermediate roll;

a second transfer box disposed between said intermediate roll and the first dryer such that the transfer felt is disposed between the web and said second box, said second box being oriented relative to the transfer felt such that a partial vacuum is generated between the transfer felt and said second box for drawing the web into close conformity with the transfer felt between said intermediate roll and the first dryer such that any tendency of the web to droop relative to the transfer felt between the lead-in roll and the first dryer is inhibited and;

a plurality of air jets disposed adjacent to said intermediate roll such that the web and transfer felt are disposed between said plurality of jets and said intermediate roll, said plurality of jets supporting the web in the cross-machine direction, said plurality of jets directing a flow of air against the web for supporting the web against the transfer felt particularly when the tail of the web is being transferred between the pressing section and the drying section.

16. An apparatus as set forth in claim 15 wherein said plurality of air jets are each supplied with pressurized air such that the web is supported in a cross-machine direction regardless of the width of the web.

17. An apparatus as set forth in claim 1 wherein said second transfer box further includes a first side disposed adjacent to the transfer felt such that the transfer felt is disposed between the web and said first side, said first side defining a first and a second edge orifice means such that when said second transfer box is connected to a source of pressurized air, air flows from said second transfer box through, respectively, said first and second edge orifice means for drawing the respective side edges of the web into close conformity with the transfer felt.

18. An apparatus for assisting the transfer of a web disposed contiguous relative to a transfer felt such that the web is transferred from a lead-in roll disposed adjacent to a press section to a first dryer or a papermaking machine dryer section, said apparatus comprising:

an intermediate support roll disposed between the lead-in roll and the first dryer such that the transfer felt is disposed between the web and said intermediate roll;

a first transfer box disposed between the lead-in roll and said intermediate roll such that the transfer felt is disposed between the web and said first box, said first transfer box being oriented relative to the transfer felt such that a partial vacuum is generated between said first box and the transfer felt for drawing the web into close conformity with the transfer felt between the lead-in roll and said intermediate roll;

a second transfer box disposed between said intermediate roll and the first dryer such that the transfer felt is disposed between the web and said second box, said second box being oriented relative to the transfer felt such that a partial vacuum is generated between the transfer felt and said second box for drawing the web into close conformity with the transfer felt between said intermediate roll and the first dryer such that any tendency of the web to droop relative to the transfer felt between the lead-in roll and the first dryer is inhibited;

said second transfer box further including:

a first side disposed adjacent to the transfer felt such that the transfer felt is disposed between the web and said first side, said first side defining a first and a second edge orifice means such that when said second transfer box is connected to a source of pressurized air, air flows from said second transfer box through, respectively, said first and second edge orifice means for drawing the respective side edges of the web into close conformity with the transfer felt; and said first and second edge orifice means utilizing the Coanda Principle to direct a first and second curtain of air away from each other in the cross-machine direction for maintaining the respective edges of the web in close conformity with the transfer felt.

19. An apparatus as set forth in claim 18 wherein said first and second curtains of air extend substantially between said intermediate roll and the first dryer.

20. An apparatus as set forth in claim 19 wherein said second transfer box further includes a first and second side wall such that said first and second side walls are connected with said first side adjacent to said first and second edge orifice means respectively, the junctures of said first and second side walls with said first side being beveled such that second side and second curtains of air flow from said first and second edge orifice means respectively away from each other in a crossmachine direction, and thereafter flow substantially perpendicularly relative to the transfer felt along said first and second side walls respectively thereby reducing the possibility of the first and second curtains of air disturbing the tail when it is being transferred between the press section and the dryer section.

21. An apparatus for assisting the transfer of a web disposed contiguous relative to a transfer felt such that the web is transferred from a lead-in roll disposed adjacent to a press section to a first dryer of a papermaking machine dryer section, said apparatus comprising:

an intermediate support roll disposed between the lead-in roll and the first dryer such that the transfer felt is disposed between the web and said intermediate roll;

a first transfer box disposed between the lead-in roll and said intermediate roll such that the transfer felt is disposed between the web and said first box, said first transfer box being oriented relative to the transfer felt such that a partial vacuum is generated between said first box and the transfer felt for drawing the web into close conformity with the transfer felt between the lead-in roll and said intermediate roll;

said first transfer box further including:

a first wall disposed adjacent to the transfer felt, said first wall diverging relative to the transfer felt in a direction from the lead-in roll towards said intermediate roll such that during transfer of the web from the lead-in roll toward said intermediate roll a partial vacuum is generated between said first wall and the transfer felt for drawing the web into close conformity with the transfer felt;

a second transfer box disposed between said intermediate roll and the first dryer such that the transfer felt is disposed between the web and said second box, said second box being oriented relative to the transfer felt such that a partial vacuum is generated between the transfer felt and said second box for drawing the web into close conformity with the transfer felt between said intermediate roll and the first dryer such that any tendency of the web to droop relative to the transfer felt between the lead-in roll and the first dryer is inhibited; and said second transfer box further including:

a first side disposed adjacent to the transfer felt, said first side diverging relative to the transfer felt in a direction from said intermediate roll towards the first dryer such that during transfer of the web from said intermediate roll towards the first dryer, a partial vacuum is generated between said first side and the transfer felt for drawing the web into close conformity with the transfer felt.

22. A method for assisting the transfer of a web disposed contiguous relative to a transfer felt such that the web is transferred from a lead-in roll disposed adjacent to a press section to a first dryer of a papermaking machine dryer section, the method comprising the steps of:

guiding the web from the press section towards the lead-in roll such that the web is disposed in close conformity with the transfer felt between the lead-in roll and the first dryer;

supplying pressurized air to a first transfer box disposed between the lead-in roll and an intermediate roll such that air flows from the first transfer box through a first outlet disposed adjacent to the intermediate roll such that the flow of air through the first outlet augments an under-pressure generated between the first transfer box and the transfer felt for drawing the web into close conformity with the transfer felt; and supplying pressurized air to a second transfer box disposed between the intermediate roll and the first dryer such that air flows from the second transfer box through a second outlet disposed adjacent to the nip defined by the transfer felt and the first dryer such that an under-pressure is generated in the vicinity of this nip thereby inhibiting any tendency of the web to detach from the transfer felt in the vicinity of this nip.

23. An apparatus for assisting the transfer of a web disposed contiguous relative to a transfer felt such that the web is transferred from a lead-in roll disposed adjacent to a press section to a first dryer of a papermaking machine dryer section, said apparatus comprising:

an intermediate support roll disposed between the lead-in roll and the first dryer such that the transfer felt is disposed between the web and said intermediate roll;

a first transfer box disposed between the lead-in roll and said intermediate roll such that the transfer felt is disposed between the web and said first box, said first transfer box being oriented relative to the transfer felt such that a partial vacuum is generated between said first box and the transfer felt for drawing the web into close conformity with the transfer felt between the lead-in roll and said intermediate roll;

said first transfer box further including:

a first wall disposed adjacent to the transfer felt, said first wall diverging relative to the transfer felt in a direction from the lead-in roll towards said intermediate roll such that during transfer of the web from the lead-in roll toward said intermediate roll, a partial vacuum is generated between said first wall and the transfer felt for drawing the web into close conformity with the transfer felt, said first wall defining first and second side orifice means;

said first and second side orifice means being disposed such that when said first transfer box is connected to a source of pressurized air, air flows from said first transfer box through respectively, said first and second side orifice means for drawing the respective side edges of the web into close conformity with the transfer felt;

a second transfer box disposed between said intermediate roll and the first dryer such that the transfer felt is disposed between the web and said second box, said second box being oriented relative to the transfer felt such that a partial vacuum is generated between the transfer felt and said second box for drawing the web into close conformity with the transfer felt between said intermediate roll and the first dryer such that any tendency of the web to droop relative to the transfer felt between the lead-in roll and the first dryer is inhibited; and said second transfer box further including:

a first side disposed adjacent to the transfer felt, said first side diverging relative to the transfer felt in a direction from said intermediate roll towards the first dryer such that during transfer of the web from said intermediate roll towards the first dryer, a partial vacuum is generated between said first side and the transfer felt for drawing the web into close conformity with the transfer felt.

24. An apparatus for assisting the transfer of a web disposed contiguous relative to a transfer felt such that the web is transferred from a lead-in roll disposed adjacent to a press section to a first dryer of a papermaking machine dryer section, said apparatus comprising:

an intermediate support roll disposed between the lead-in roll and the first dryer such that the transfer felt is disposed between the web and said intermediate roll;

a first transfer box disposed between the lead-in roll and said intermediate roll such that the transfer felt is disposed between the web and said first box, said first transfer box being oriented relative to the transfer felt such that a partial vacuum is generated between said first box and the transfer felt for drawing the web into close conformity with the transfer felt between the lead-in roll and said intermediate roll;

said first transfer box further including:

a first wall disposed adjacent to the transfer felt, said first wall diverging relative to the transfer felt in a direction from the lead-in roll towards said intermediate roll such that during transfer of the web from the lead-in roll toward said intermediate roll a partial vacuum is generated between said first wall and the transfer felt for drawing the web into close conformity with the transfer felt, said first wall defining first and second side orifice means;

said first and second side orifice means being disposed such that when said first transfer box is connected to a source of pressurized air, air flows from said first transfer box through respectively, said first and second side orifice means for drawing the respective side edges of the web into close conformity with the transfer felt;

a second transfer box disposed between said intermediate roll and the first dryer such that the transfer felt is disposed between the web and said second box, said second box being oriented relative to the transfer felt such that a partial vacuum is generated between the transfer felt and said second box for drawing the web into close conformity with the transfer felt between said intermediate roll and the first dryer such that any tendency of the web to droop relative to the transfer felt between the lead-in roll and the first dryer is inhibited;

said second transfer box further including:

a first side disposed adjacent to the transfer felt, said first side diverging relative to the transfer felt in a direction from said intermediate roll towards the first dryer such that during transfer of the web from said intermediate roll towards the first dryer, a partial vacuum is generated between said first side and the transfer felt for drawing the web into close conformity with the transfer felt, said first side defining first and second edge orifice means;

said first and second edge orifice means being disposed such that when said second transfer box is connected to a source of pressurized air, air flows from said second transfer box through respectively said first and second edge orifice means for drawing the respective side edges of the web into close conformity with the transfer felt.

25. An apparatus as set forth in claim 24 wherein said first side defines a second outlet means disposed ajdacent to the first dryer such that when said second transfer box is connected to a source of pressurized air, air flows from within said second transfer box through said second outlet means perpendicularly relative to the direction of movement of the transfer felt so that an under-pressure is generated in the vicinity of the ingoing nip defined by the transfer felt and the first dryer, said under-pressure tending to inhibit detachment of the web from the transfer felt in the vicinity of said nip.

26. An apparatus for assisting the transfer of a web disposed contiguous relative to a transfer felt such that the web is transferred from a lead-in roll disposed adjacent to a press section to a first dryer of a papermaking machine dryer section, said apparatus comprising:

a transfer box disposed between the lead-in roll and the first dryer such that the transfer felt is disposed between the web and said first box, said transfer box being oriented relative to the transfer felt such that a partial vacuum is generated between said box and the transfer felt for drawing the web into close conformity with the transfer felt between the lead-in roll and the first dryer;

said transfer box further including:

a side disposed adjacent to the transfer felt, said side diverging relative to the transfer felt in a direction from the lead-in roll towards the first dryer such that during transfer of the web from the lead-in roll towards the first dryer, a partial vacuum is generated between said side and the transfer felt for drawing the web into close conformity with the transfer felt, said side defining a first and second edge orifice means;

said first and second edge orifice means being disposed such that when said transfer box is connected to a source of pressurized air, air flows from said transfer box through respectively said first and second edge orifice means for drawing the respective side edges of the web into close conformity with the transfer felt; and said side also defining an outlet means disposed adjacent to the first dryer such that when said transfer box is connected to a source of pressurized air, air flows from within said transfer box through said outlet means perpendicularly relative to the direction of movement of the transfer felt and thereafter tangentially relative to the first dryer so that an under-pressure is generated in the vicinity of the ingoing nip defined by the transfer felt and the first dryer, said under-pressure tending to inhibit detachment of the web from the transfer felt in the vicinity of said nip.

* * * * *